US011085615B2

(12) United States Patent
Sevack et al.

(10) Patent No.: US 11,085,615 B2
(45) Date of Patent: Aug. 10, 2021

(54) PLASTER FRAME WITH ADJUSTABLE OPENING FOR RECESSED LUMINAIRES

(71) Applicant: Tripar, Inc., Montreal (CA)

(72) Inventors: Lloyd Sevack, Dollard-des-ormeaux (CA); Abdelmoula Elbannaoui, Montreal (CA); Ovidiu Ivan, Montreal (CA); Abdelkrim Oudian, Montreal (CA)

( * ) Notice: Subject to any disclaimer, the term of this patent is extended or adjusted under 35 U.S.C. 154(b) by 0 days.

(21) Appl. No.: 16/866,500

(22) Filed: May 4, 2020

(65) Prior Publication Data

US 2020/0363041 A1 Nov. 19, 2020

Related U.S. Application Data

(60) Provisional application No. 62/848,208, filed on May 15, 2019.

(51) Int. Cl.
*F21V 21/03* (2006.01)
*F21V 21/14* (2006.01)
*F21V 11/10* (2006.01)

(52) U.S. Cl.
CPC ..... *F21V 21/03* (2013.01); *F21V 21/14* (2013.01); *F21V 11/10* (2013.01)

(58) Field of Classification Search
CPC ..... F21V 21/03; F21V 21/04; F21V 21/041; F21V 21/042; F21V 21/043; F21V 21/044; F21V 21/045; F21V 21/046; F21V 21/047; F21V 21/048; F21V 21/049; F21V 21/14; F21V 21/30; F21V 11/08; F21V 11/10; F21V 11/12; F21V 14/08; F21V 14/085; F21V 17/002; F21V 17/02; F21S 8/026; F21S 8/04; F21S 8/043; E04B 9/006
See application file for complete search history.

(56) References Cited

U.S. PATENT DOCUMENTS

| | | | | |
|---|---|---|---|---|
| 5,618,017 A * | 4/1997 | De Boer | E04B 9/006 | 248/201 |
| 5,746,507 A * | 5/1998 | Lee | F21V 21/04 | 362/147 |
| 7,374,308 B2 | 5/2008 | Sevack et al. | | |
| 2004/0066565 A1* | 4/2004 | Woods | G03B 9/06 | 359/739 |

* cited by examiner

*Primary Examiner* — Bryon T Gyllstrom
*Assistant Examiner* — James M Endo
(74) *Attorney, Agent, or Firm* — Alfred M. Walker

(57) ABSTRACT

A plaster frame is provided for recessed lighting luminaires, wherein the main hole size is not fixed, but adjustable, and in more than one shape opening, e.g. round, square, rectangular, and other opening shapes as required. The plaster frame has an adjustable hole, the concept here disclosed comprises a series of moving leaves and may also contain an actuating ring, the rotation of which cause the leaves to move inward or outward, changing the hole, or aperture. Although fasteners may be used to retain the various moving elements, these adjustable openings can also be utilized without the use of any fasteners.

18 Claims, 9 Drawing Sheets

PLASTER FRAME WITH ADJUSTABLE OPENING FOR RECESSED LUMINAIRES

RELATED APPLICATIONS

This application claims priority under 35 USC 119 (e) from provisional application Ser. No. 62/848,208, filed May 15, 2019, which application is incorporated by reference herein.

FIELD OF THE INVENTION

This invention relates to plaster frames for recessed lighting luminaires, wherein the main hole size is not fixed, but adjustable, and in more than one geometric shape opening.

BACKGROUND OF THE INVENTION

Recessed lighting fixtures are commonly held up in ceilings prior to installation of the ceiling panel by way of two bars, commonly known as bar hangers that support a pan, commonly referred to as a plaster frame. The plaster frame has amongst other features, a central or main hole (can be round, square, rectangular, or other odd shapes), sized to accept a given recessed luminaire.

The size of the main hole in the plaster frame must be specific and accurate, as it:

a. serves as a template to cut the hole in the ceiling panel;
b. must be large enough to accept the luminaire; and
c. must not be so large as to prevent from being concealed by the luminaire's flange.

For all these reasons, lighting manufacturers (OEMs) typically need to stock multiple plasters frame models to accommodate a variety of recessed luminaires, each model often requiring a plaster frame containing a different main hole size that are otherwise identical.

Shortcomings of current systems include:

1. OEMs are usually required to stock plaster frames with a multitude of different hole sizes that are otherwise the same.
2. Alternatively, an OEM can stock a single plaster frame with a large hole, onto which reducer rings or plates (often referring to as "goof plates") can be riveted to reduce the hole size as required. Here too, a multitude of reducer plates containing different holes sizes must be stocked.
3. Given the varying hole sizes required, OEMs must predict sales. As markets dictate, they are invariably left with surplus plaster frames containing certain hole diameters, and shortfalls on others which can only be corrected upon ordering and receiving subsequent orders.

SUMMARY OF THE INVENTION

To overcome the above shortcomings the object of this invention is a plaster frame with an adjustable hole.

This invention relates to a new concept in plaster frames, wherein the main hole size is not fixed, but adjustable, and in more than one shape opening, e.g. round, square, rectangular, and other opening shapes as required.

Such a plaster frame may cost more than one with a fixed hole due to added complexity. However, given that its flexibility will reduce the number of different models an OEM must stock, this will greatly increase the chances of the OEM having the size needed, and when needed.

FIGS. 1-3 relate to a plaster frame with an adjustable round hole.

FIGS. 4 and 5 relate to a plaster frame with an adjustable square or rectangular hole showing the top side and the ceiling face respectively.

In the case of a plaster frame with an adjustable round hole, the concept here disclosed comprises a series of moving leaves and an actuating ring, the rotation of which cause the leaves to move inward or outward, changing the hole, or aperture, as well as an alternate concept that does not require an actuating ring, whereby the leaves may still be moved inward or outward, changing the hole, or aperture. The mechanism itself is similar to that used in camera lenses for aperture adjustment.

In the case of a plaster frame with a square or rectangular hole, two L-shaped leaves may be slid inward or outward, changing the opening through a range of possible openings.

Although fasteners may be used to retain the various moving elements, it is a further object of this intention to achieve these adjustable openings without the use of any fasteners where possible, which would otherwise add components, component cost, assembly time, and resultant cost, except for the purpose of locking the mechanism to the desired opening.

BRIEF DESCRIPTION OF THE DRAWINGS

The present invention can best be understood in connection with the accompanying drawings. It is noted that the invention is not limited to the precise embodiments shown in the following drawings, in which.

DETAILED DESCRIPTION OF THE DRAWINGS

Figure 1:
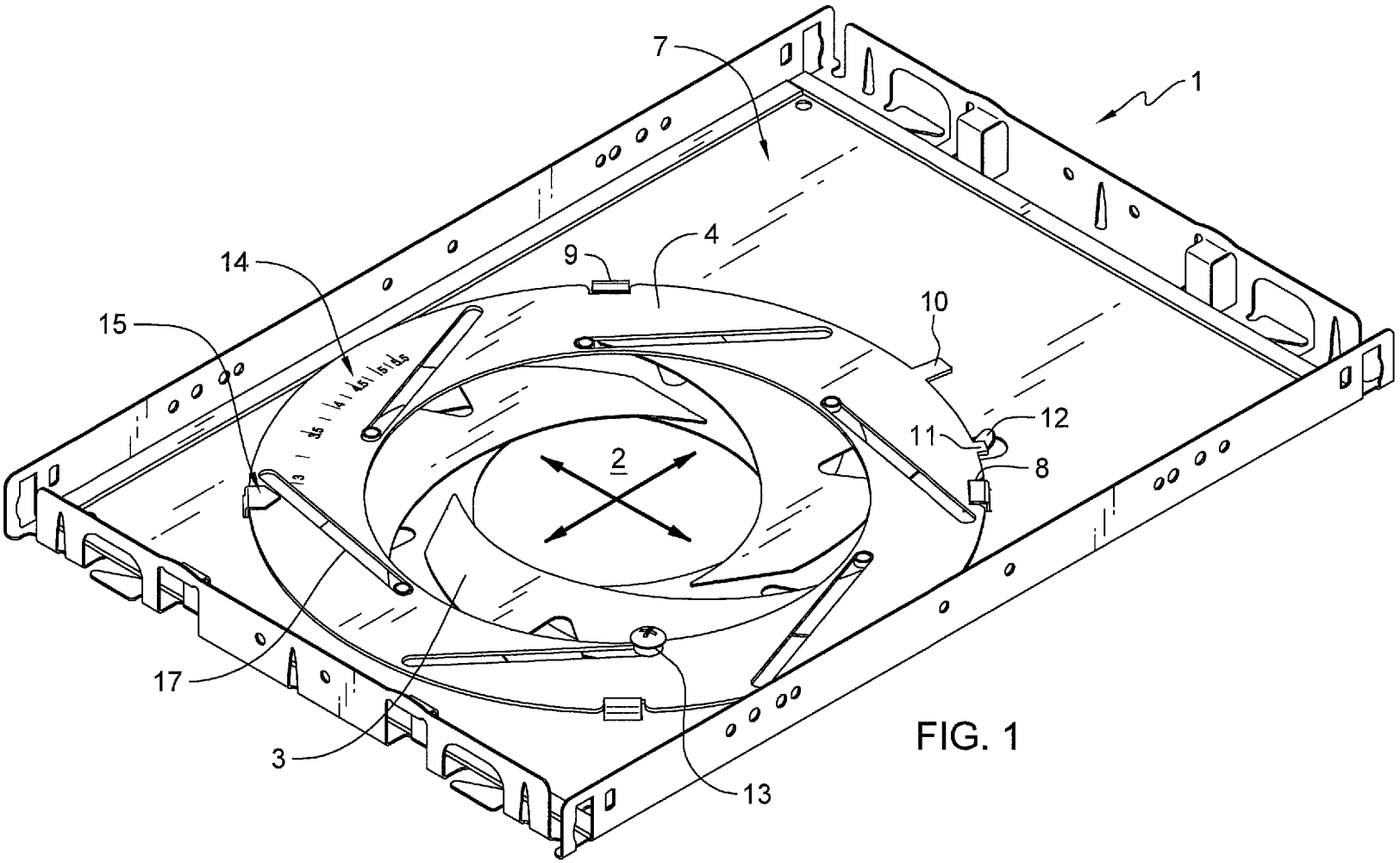
FIG. 1 is a perspective top view of a plaster frame with a round adjustable opening
Figure 2:
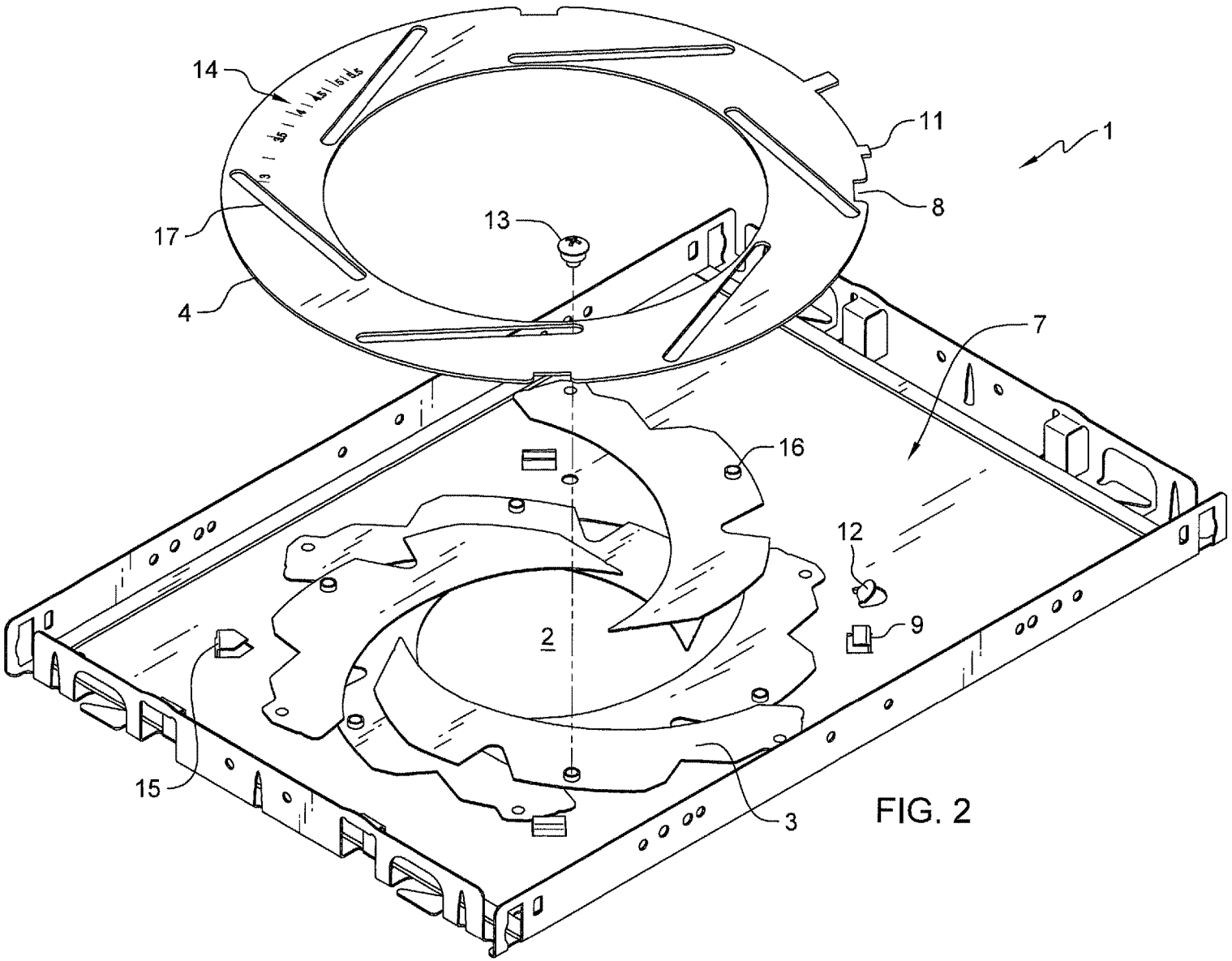
FIG. 2 is an exploded view of the plaster frame of FIG. 1
Figure 3:
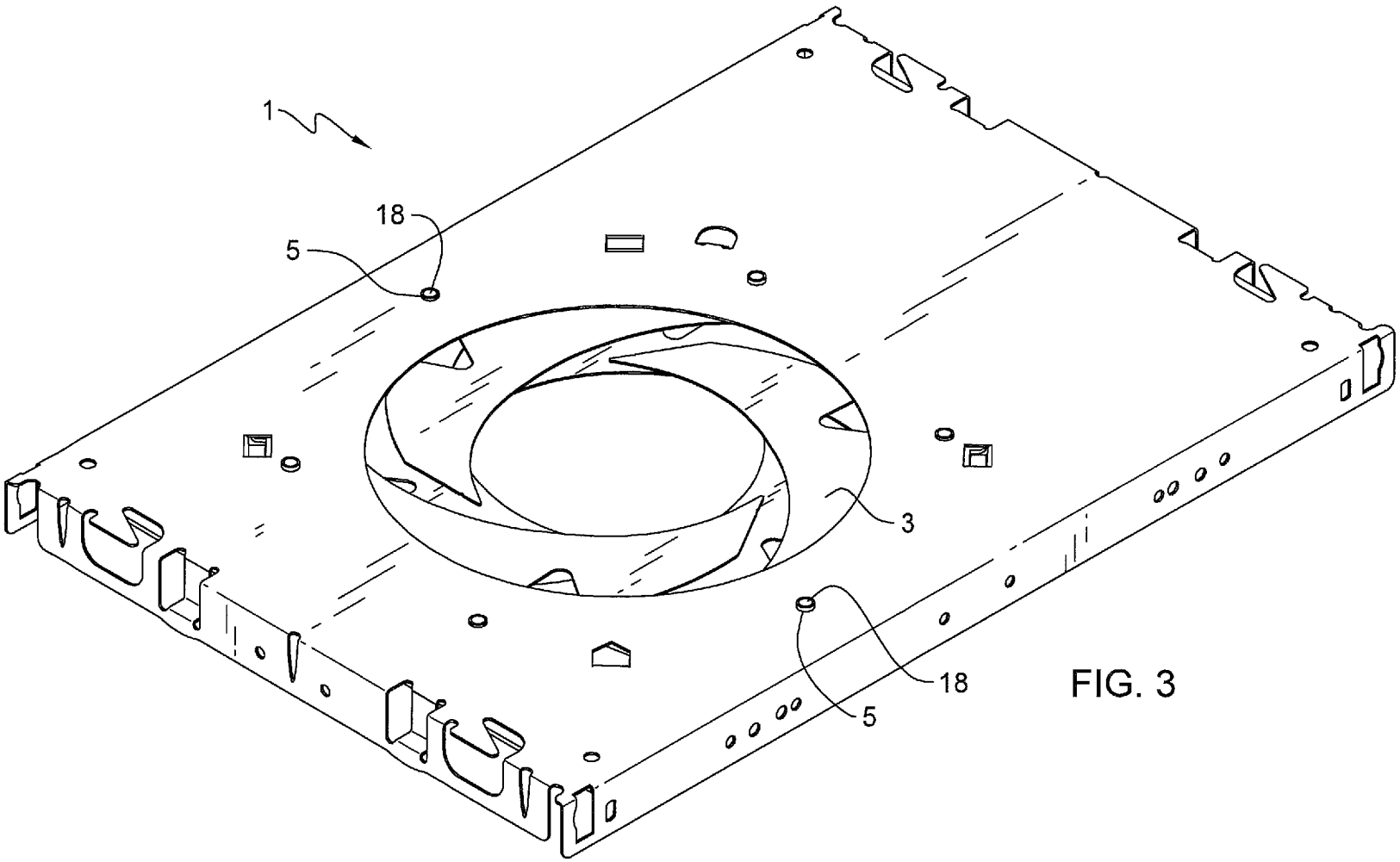
FIG. 3 is a perspective view of the bottom face (the face that would contact the topside of a ceiling panel) of the plaster frame of FIG. 1

To minimize the number of fasteners required, an example of this is shown in FIGS. 1-3 herein for the adjustable round role plaster frame. This shows the leaves (3) each having a round protrusion (18) on the bottom side, which engage in leaf mating holes (5) on plaster frame (7), serving as points of rotation for the complete assembly. Leaves (3) each also have round protrusions (16) on the top side (7) which engage in leaf slots (17) of actuating ring (4), serving as guideways to rotate leaves (3) about points of rotation (5) for the complete assembly.

Assembly of the round hole plaster frame is as follows (see FIGS. 1 and 2):

1) Three of the leaves (3) are placed onto the top side (7) of the plaster frame (1), located approximately 120 degrees apart, oriented so the protrusion (18) on one face of each leaf engages into three of the six small recipient leaf mating holes (5) that astride the main hole in the plaster frame.
2) Three additional leaves (3) are placed on top of the three already placed leaves, also approximately 120 degrees apart, (but with all three rotated approximately 60 degrees from the three previously installed), and their protrusions (18) on one face engaged into the three remaining recipient leaf mating holes (5).
3) The actuating ring (4) is slipped at a slight angle under pointed lance (15), and the actuating ring lowered onto the leaves (3), oriented so the three equidistant notches (8) on the ring's outer periphery are aligned with the three blunt nose lances (9) in the plaster frame, and the protrusion (16) on the top side of each leaf (3), falls into the guiding slots (17) of the actuating ring (4).
4) The actuating ring is then rotated (by holding the actuating ring lever 10), so the three equidistant notches (8) on the ring's outer periphery slide under and are no longer aligned with the three lances (9) in the plaster frame, thus preventing the actuating ring from lifting, which also retains the leaves.
5) To prevent the actuating ring from being reoriented into the position described in step 4, the actuating ring (4) is rotated further, until the actuating ring stopper (11) rotates past the flat or unbent plaster frame stopper (12), after which the plaster frame stopper (12) is bent upwards, so as to prevent the actuating ring stopper (11) from rotating back past the plaster frame stopper (12).

Locking the opening to the desired opening may be achieved in a number of ways:

1) A drill may be used to pierce though both moving and fixed elements, with a screw, rivet, or other fastener placed through the piercings.
2) A centerpunch may be used to strike one or more of the lances that hold the moving elements, which will displace the struck portion into the moving element, the interference of which will prevent further movement.
3) A screw (13) for the round hole plaster frame, and (23) for the square hole plaster frame) may be threaded into one of the suitable holes, which will restrict moving elements once impinged upon.

Because there are graduations (14) for the round hole plaster frame, and (24) for the square hole plaster frame) within at least one of the moving parts indicating the resultant hole size when the graduations are aligned with the opening marker (15) for the round hole plaster frame, and (25) for the square hole plaster frame), the size of the opening may be adjusted and locked to a required size as per the requirements of the OEM or installer's recessed luminaires. Though both plaster frames contain graduations to permit this, OEMs may choose not to rely on using such graduations for two reasons: precision and speed. To improve both, a simple lightweight plug gauge can be used, to which the opening can be closed against, locked, then the gauge removed, ensuring precision, repeatability, and reduced assembly time. Lances (29) guide the leaves for the square hole plaster frame (20).

Having the ability to offset the square or rectangular hole with respect to the centerline of the plaster frame is a benefit in certain instances. For example, if a specific plaster frame in what is supposed to be a straight line of luminaires has to be shifted a bit to avoid obstructions in the ceiling, the ability to offset the square or rectangular hole helps to realign affected fixtures to leave all in a straight line.

Though this current patent application depicts the round hole plaster frame being made using six leaves, it is obvious that this could be made with fewer leaves, though a less perfect circular adjustable hole may result, having increased diametral variation across the various hole axes. Conversely, the round hole plaster frame could be made with an increasing number of leaves, offering holes with decreased diametral variation across the various adjustable hole axes.

Figure 4:
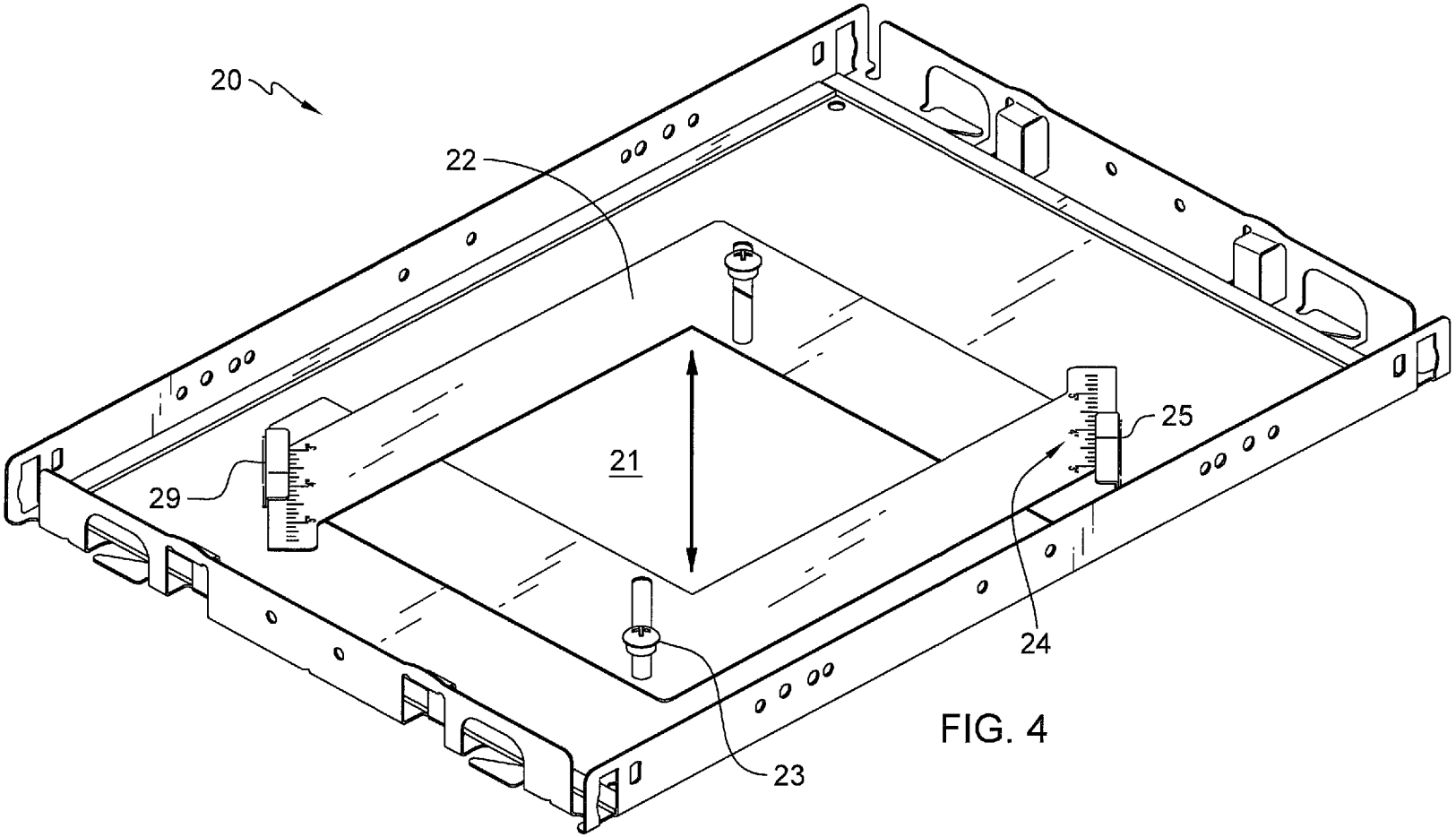
FIG. 4 is a top perspective view of a plaster frame with a square adjustable opening.
Figure 5:
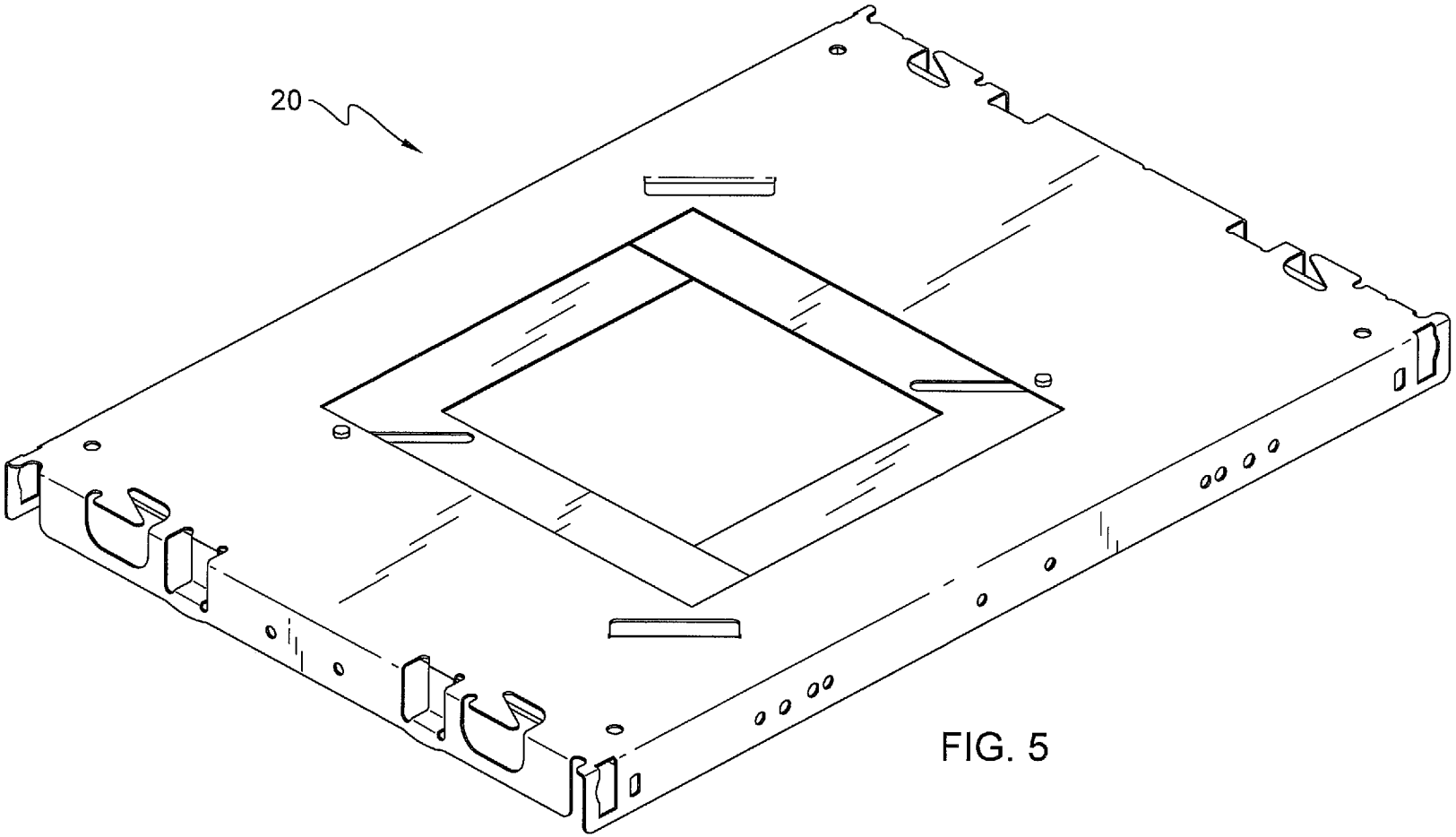
FIG. 5 is a perspective view of the bottom face (the face that would contact the topside of a ceiling panel) of the plaster frame of FIG. 4.

Similarly, and although this current patent application depicts the square hole plaster frame of FIGS. 4 and 5 being made using two L-shaped leaves, it is obvious that this could be made with alternate shapes leaves (for example straight, triangular, etc.), in order to obtain a rectangular, triangular or other shaped adjustable holes as required.

The various small holes in the plaster frame required to house the various moving elements can introduce excess airflow when mounted to an insulated ceiling (IC) box, resulting in higher than permissible airflow requirements. In order to maintain airflow levels below any regional state, or national electrical code that may be imposed for certain applications, the following techniques may be employed:

For airtight applications (when used in conjunction with an airtight IC Box), a square piece of adhesive-backed aluminized foil or gasketing may be applied to the bottom (ceiling side of the plaster frame), sized to cover the largest opening as well as the small perforations beyond (that exist to hold the moving elements). The complete luminaire could be shipped this way, with the foil or gasket completely covering the hole. As is common installation practice, and because the main hole in the plaster frame serves as a template to cut the hole in the ceiling panel, when the installer punches, pierces or cuts through the ceiling panel, this would also perforate this foil or gasket, and the hole opened up as usual, to the perimeter of the plaster frame hole opening, using it as a template. This also prevents dust from entering the IC Box, as the hole remains closed off during construction, and is only opened at the final stages when the luminaire is installed.

Figure 6:
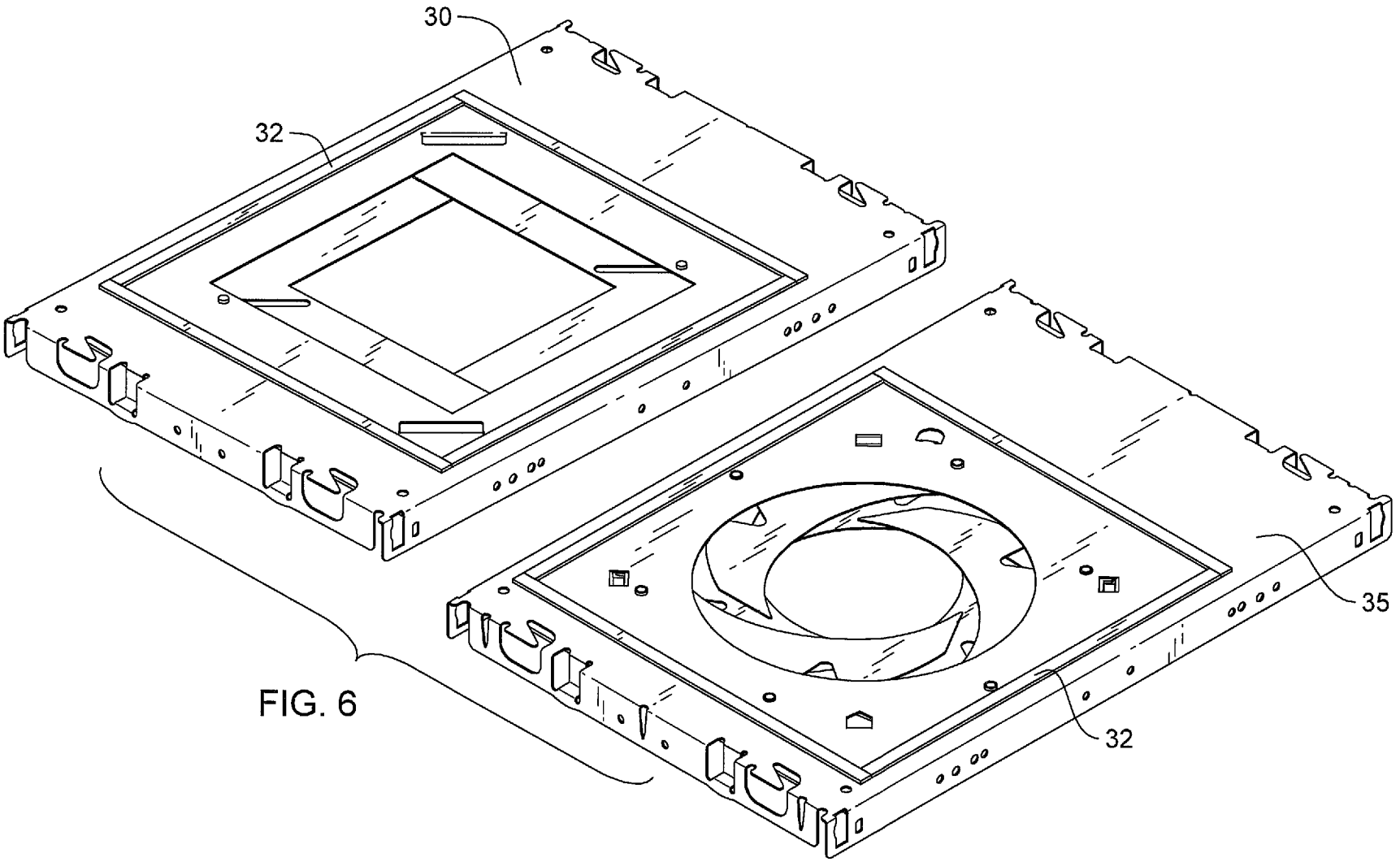
FIG. 6 is a ceiling face view of plaster frames with gasketed faces.

Alternately, and as shown in FIG. 6, strips of adhesive-backed gasket (32) may be placed on the bottom (ceiling) face of the frame, extending past the outermost holes/slots/lances created inherent with the design. When placed onto the topside of a ceiling, this gasket makes contact with it, sealing off the various holes within this space.

As shown in FIGS. 4 and 5, plaster frame (20) with an adjustable light opening includes a top side surrounded by upwardly directed walls for mounting in a ceiling recess with a fixed main hole (21); and at least a pair of overlapping L-shaped (22) leaves mounted on an upwardly facing side of the top side framing the fixed main hole (21). The L-shaped leaves (22) are movable inwardly, partially covering the fixed main hole (21) forming a square or rectangular opening through the fixed main hole (21) wherein the shape of the opening (square or rectangular) is dependent on the angle of lances (29) with respect to the orientation of the fixed main hole (21), and the size of the opening depends on positions of the L-shaped leaves (22) partially covering the fixed main hole (21). Lances (29) are provided for restraining and slidably adjusting the leaves (22) in position for a selected light opening. Leaves (22) also contain graduations (24) indicating the resultant hole size when the desired graduation is aligned with the opening indicator line (25) on the topside of lances (29). To lock the L-shaped leaves (22) once a predetermined opening is obtained, there are threadable protrusions on the top side of plaster frame (20) to accommodate screws (23) which pass through slots in each leaf (22), the tightening of which prevents movement of leaves (22).

Figure 7:
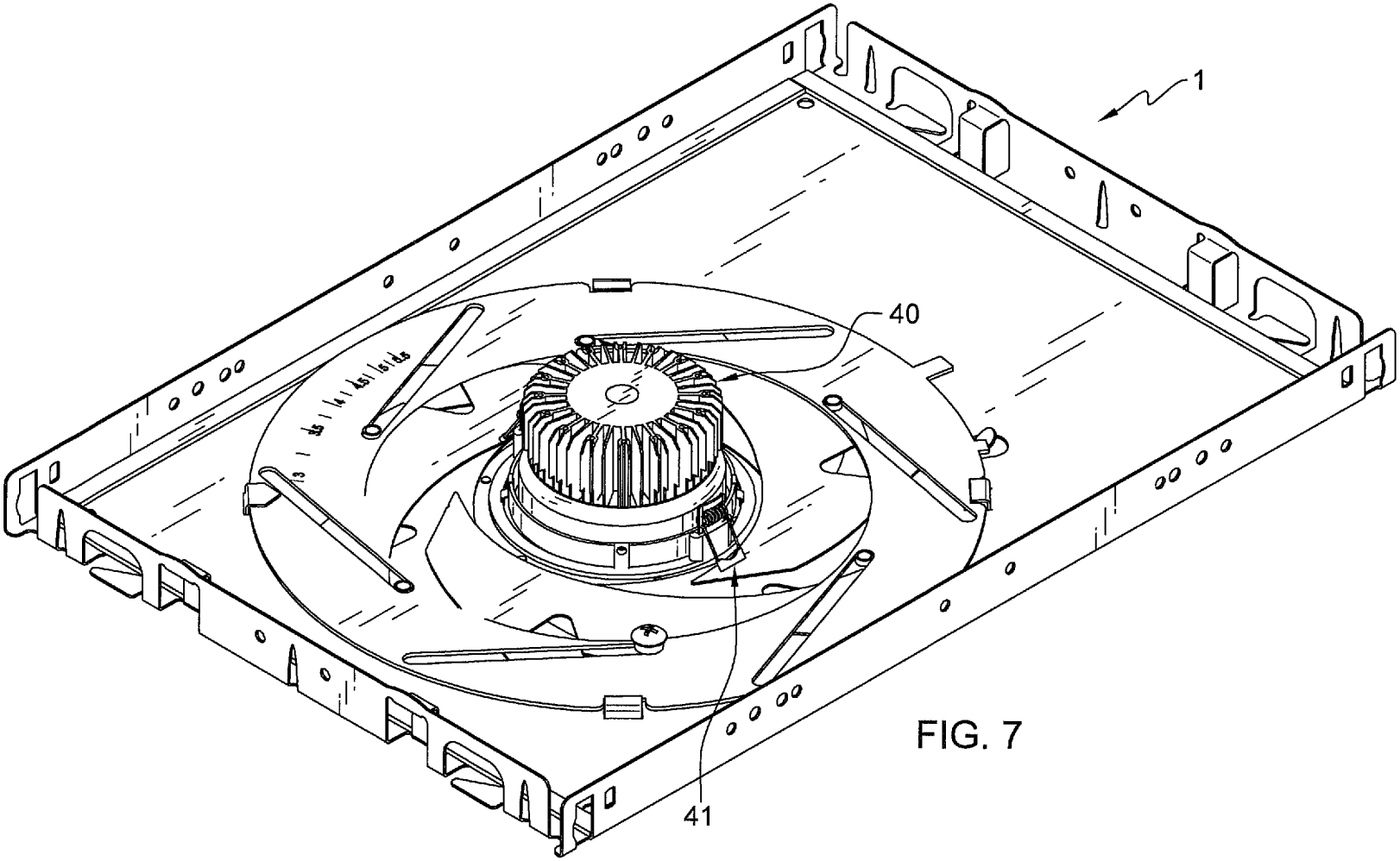
FIG. 7 is a perspective view of the top of an adjustable hole plaster frame with a luminaire installed.

FIG. 7 shows the top side of plaster frame (1) with luminaire (40) installed being attached by a pair (one shown) of "mousetrap" springs (41).

Figure 8:
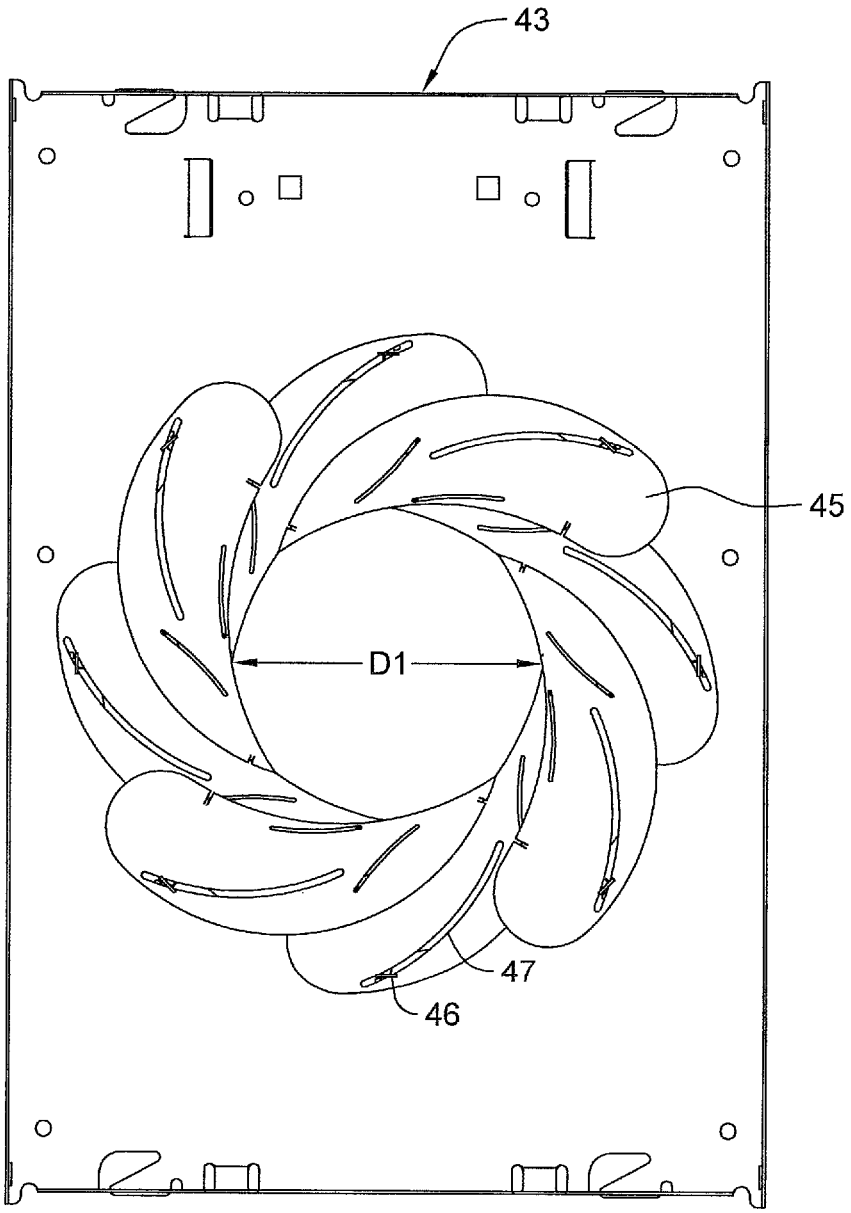
FIG. 8 is a top plan view of an adjustable round hole plaster frame not using an actuating ring; this is a non-preferred embodiment showing a minimal diameter hole.
Figure 9:
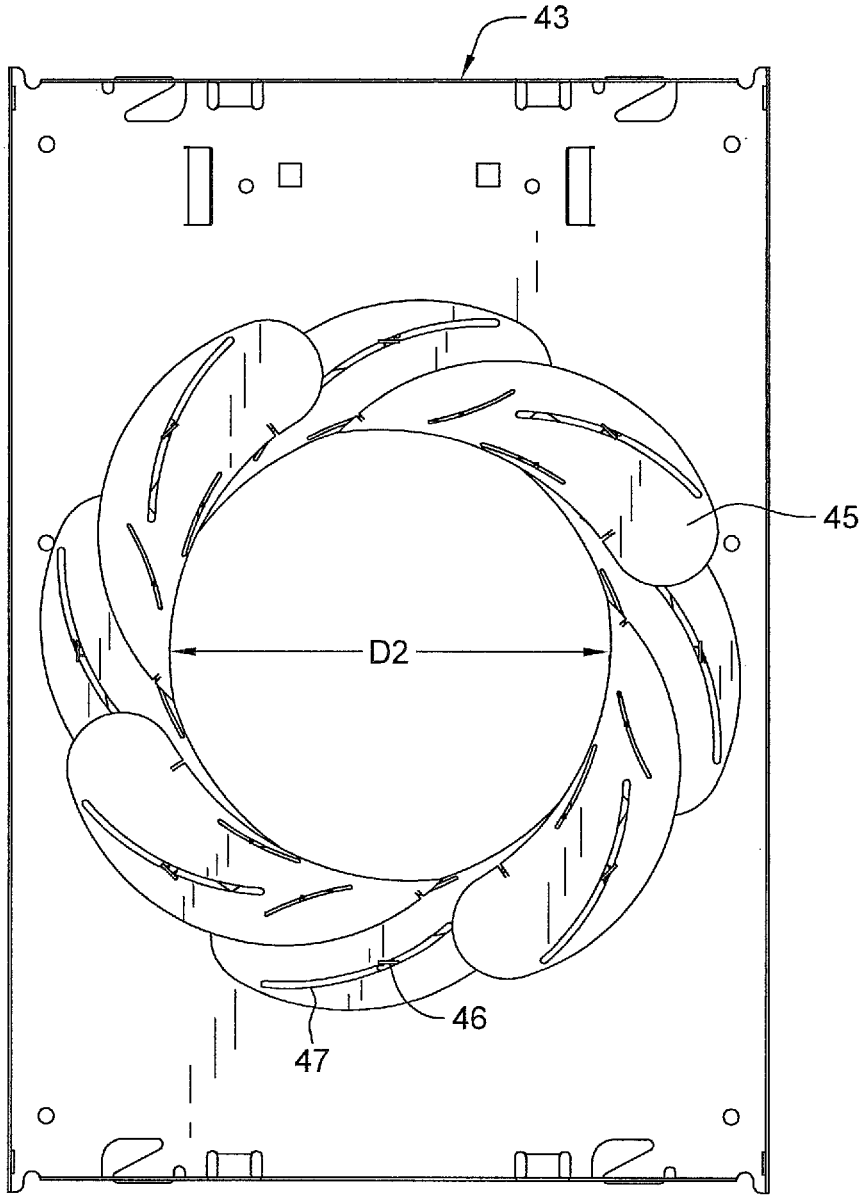
FIG. 9 is the plaster frame of FIG. 8 set for a hole of maximum diameter.

FIGS. 8 and 9 show the plan for a non-preferred embodiment of round hole adjustable plaster frame that does not use an actuating ring. Eight leaves (45) are shown in plaster frame (43), although fewer than eight or more than eight can be used. Each leaf (45) has a main guidance slot (47) into which a T-shaped tab (46) projecting upward from plaster frame (43) penetrates each guidance slot (43), whereupon it is twisted slightly so the projecting head of the T-shaped tab (46) superposes each guidance slot (43) thus restraining each leaf (45) to plaster frame (43). Since the leaves are engaged with both the substrate of frame (43) as well as other leaves, the hole size is set by pushing from the edges of the leaf set from two sides together to reduce hole size, or pulling from the center of the hole outward to enlarge the hole. Once the desired hole size is obtained, locking is achieved by further twisting one or more of the T-shaped tabs (46) until the twisted tabs impinge upon and lock against the side walls of guidance slots (47). FIG. 8 shows the minimum size D1 while FIG. 9 shows the maximum size D2.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A plaster frame with an adjustable luminaire opening for mounting in a ceiling recess containing a light fixture comprising:

a frame unit having a top side and a bottom side with a fixed main hole accommodating the light fixture therein;

a plurality of movable, overlapping leaves atop said plaster frame for setting a size of said adjustable luminaire opening to engage with said light fixture;

means for setting said leaves to produce a desired approximately round opening within said fixed main hole to accommodate said light fixture; and, a locking member in said top side for locking said adjustable opening by locking said leaves in position for said light fixture;

wherein said means for setting for said leaves to produce a desired approximately round opening within said fixed main hole to accommodate said light fixture is an actuating ring mounted for rotation on said top side; said actuating ring having an opening equal to or larger than said fixed main hole, and a number of guiding slots in said actuating ring surrounding said opening.

2. A plaster frame with an adjustable light opening comprising:

a top side surrounded by downwardly directed walls for mounting in a ceiling recess;

a fixed main hole formed in said top side;

a pair of overlapping leaves containing an L-shaped cut-out, mounted on a downwardly facing side of said top side framing said fixed main hole;

said leaves being movable inwardly partially covering said fixed main hole forming a square or rectangular opening through said fixed main hole, a size of said square or rectangular opening depending on positions of said leaves partially covering said fixed main hole; and, means for locking said leaves in position for a selected opening.

3. The plaster frame of claim 2, in which said means for locking said leaves in place comprises threadable openings in said leaves to accommodate screws for locking down said leaves in place once a predetermined square or rectangular opening is obtained by positioning of said leaves.

4. The plaster frame of claim 3, further comprising indicia on legs of said leaves for positioning of said leaves to obtain a preselected resultant hole size.

5. A method of producing and using an adjustable opening in a plaster frame comprising the steps of:

inserting into a ceiling recess containing a light fixture, the plaster frame comprising a top side surrounded by downwardly directed walls, said top side having a fixed main hole;

mounting an actuating ring for rotation on a downward facing side of said top side, said actuating ring having an opening larger than or equal to said fixed main hole in said top side, and a number of guiding slots in said actuating ring surrounding said opening;

inserting a plurality of leaves between said actuating ring and said downward facing side of said top side, each leave being pivotal on said downward facing side of said top side and having a protuberance extending into one of said guiding slots whereby rotation of said actuating ring causes said leaves to pivot inwardly or outwardly depending on the direction of rotation of said actuating ring whereby a size of the adjustable opening through said fixed main hole is either reduced or enlarged;

using an actuating ring lever attached to an outer circumference of said actuating ring for use for rotating said actuating ring to obtain an opening of desired size through said fixed main hole; and locking said leaves in position for a selected opening.

6. The method of claim 5, further comprising graduations on said actuating ring for indicating resultant opening.

7. The method of claim 6, wherein said downward facing side of said top side has a plurality of lances for engagement with notches on an outer periphery of said actuating ring for aligning said actuating ring with said leaves on said downward facing side of said top side.

8. The method of claim 7, in which said step of locking said leaves comprises using a plaster frame stopper on said downward facing side of said top side for being bent upwards to prevent backward rotation of said actuating ring.

9. The method of claim 8, in which said leaves comprise comprises two sets of three leaves superimposed on each other to form a circular opening.

10. A method of producing and using an adjustable opening in a plaster frame comprising the steps of:

inserting into a ceiling recess containing a light fixture, the plaster frame comprising a top side surrounded by downwardly directed walls, said top side having a fixed main hole;

mounting a pair of overlapping leaves containing an L-shaped cut-out on a downwardly facing side of said top side framing said fixed main hole, said leaves being movable inwardly partially covering said fixed main hole forming a square or rectangular opening through said fixed main hole, a size of said square or rectangular opening depending on positions of said leaves partially covering said fixed main hole; and locking said leaves in position for a selected opening.

11. The method of claim 10, in which said step of locking said leaves in place comprises using threadable openings in said leaves to accommodate screws for locking down said leaves in place once a predetermined square or rectangular opening is obtained by positioning of said leaves.

12. The method of claim 11, including the step of placing indicia on legs of said leaves for positioning of said leaves to obtain a preselected resultant hole size.

13. A plaster frame with an adjustable luminaire opening for mounting in a ceiling recess containing a light fixture comprising:

a frame unit having a top side and a bottom side with a fixed main hole accommodating the light fixture therein;

a plurality of leaves atop said plaster frame for setting a size of said adjustable luminaire opening to engage with said light fixture;

means for setting said leaves;

means for locking said leaves in position for said light fixture; and for the light fixture requiring a round hole, an actuating ring mounted for rotation on said top side, said actuating ring having an opening equal to or larger than said fixed main hole, and a number of guiding slots in said actuating ring surrounding said opening.

14. The plaster frame of claim 13, wherein said plurality of said leaves between said actuating ring and said top side, each leaf being pivotal on said top side and having a protuberance extending into one of said guiding slots whereby rotation of said actuating ring causes said leaves to pivot inwardly or outwardly depending on the direction of rotation of said actuating ring whereby a size of the adjustable luminaire opening through said fixed main hole is either reduced or enlarged.

15. The plaster frame of claim 14, in which said leaves comprises two sets of three leaves superimposed on each other to form a circular opening.

16. The plaster frame of claim 13, wherein a downward facing side of said top side has a plurality of lances for engagement with notches on an outer periphery of said actuating ring for aligning said actuating ring with said leaves on said downward facing side of said top side.

17. The plaster frame of claim 16, in which said means for locking comprises a plaster frame stopper on said downward facing side of said top side for being bent upwards to prevent backward rotation of said actuating ring.

18. A plaster frame having an adjustable luminaire opening for mounting in a ceiling recess containing a light fixture;

comprising:

a frame unit having a top side and a bottom side with a fixed main hole accommodating the light fixture therein;

a plurality of movable, overlapping leaves atop said plaster frame for setting a size of said adjustable luminaire opening to engage with said light fixture;

means for setting said leaves to produce a desired approximately round opening within said fixed main hole to accommodate said light fixture; and a locking member in said top side for locking said adjustable opening by locking said leaves in position for said light fixture;

wherein said means for setting said leaves to produce a desired approximately round opening within said fixed main hole to accommodate said light fixture comprises said plurality of movable, overlapping leaves are arcuate pivoting leaves, controlled by pivoting movement guided by arcuate slots having tabs permitting pivoting movement of said overlapping arcuate pivoting leaves, whereupon the overlapping leaves collectively form a first open hole of a first predetermined diameter openable to a larger hole of a second, larger predetermined diameter, upon pivoting of the arcuate leaves.

* * * * *